United States Patent [19]

Johansson

[11] 4,220,290

[45] Sep. 2, 1980

[54] CONVEYOR DEVICE FOR FEEDING LIGNOCELLULOSIC MATERIAL TO A DISC-TYPE GRINDING APPARATUS

[75] Inventor: Johan G. I. Johansson, Taby, Sweden

[73] Assignee: Defibrator Aktiebolag, Stockholm, Sweden

[21] Appl. No.: 5,378

[22] Filed: Jan. 22, 1979

[30] Foreign Application Priority Data

Jan. 24, 1978 [SE] Sweden ..... 7800881

[51] Int. Cl.[3] ..... B02C 7/11

[52] U.S. Cl. ..... 241/247; 241/261.2

[58] Field of Search ..... 425/207, 208, 209, 204; 198/662, 670, 676; 366/80, 81; 241/246, 247, 260.1, 277, 280, 261.2

[56] References Cited

U.S. PATENT DOCUMENTS

| | | | |
|---|---|---|---|
| 2,641,369 | 6/1953 | Mulcey et al. | 198/670 X |
| 3,441,227 | 4/1969 | Fisher | 241/247 |
| 3,812,956 | 5/1974 | Hindermann | 198/662 X |
| 4,082,233 | 4/1978 | Reinhall | 241/247 X |

*Primary Examiner*—Mark Rosenbaum
*Attorney, Agent, or Firm*—Eric Y. Munson

[57] ABSTRACT

Grinding apparatus in which lignocellulosic material such as wood chips is ground between a pair of grinding discs which rotate relatively to one another within a housing into which the material is advanced through a feed-in opening by means of a feed screw which rotates in a concentric sleeve extending between the central feed-in opening and an intake opening for the material. The feed screw comprises a series of inner screw flights mounted on a central shaft, which screw flights support and are enveloped by a series of outer ribbon-like screw flights. The inner screw flights are designed primarily to propel the material radially outwards towards the wall of the surrounding sleeve, whereas the outer ribbon-like screw flights are designed primarily to advance the material in an axial direction towards the central feed-in opening.

4 Claims, 2 Drawing Figures

CONVEYOR DEVICE FOR FEEDING LIGNOCELLULOSIC MATERIAL TO A DISC-TYPE GRINDING APPARATUS

BACKGROUND OF THE INVENTION

The present invention is concerned with grinding apparatus for lignocellulose material in lump form, such as wood chips, comprising mutually rotatable grinding means mounted inside a housing and forming between them a space to which the feed material is conveyed by a feed screw consisting of at least one ribbon-shaped screw thread mounted upon and at a radial distance from a drive shaft. This shaft is preferably cylindrical, concentric with and enclosing the drive shaft of a rotatable driving means.

OBJECT OF THE INVENTION

The main object of the invention is to ensure the evenly distributed conveyance of feed material to the intake zone between the grinding means by the band-shaped screw thread and hence improve and comminution effect and the enery consumption of the grinding process.

SUMMARY OF THE INVENTION

This is essentially achieved by fitting between the first-named shaft and the band-shaped screw thread one or more vanes so designed that the force they exert on the feed material consists entirely or almost entirely of a radial component. The vanes have preferably the form of screw threads, but with a pitch steeper than that of the outer screw thread, so that the inner screw thread will at least for the most part act upon the feed material so as to displace the latter in a radial direction only towards the outer screw thread.

According to the invention there is formed in the outer screw thread a ring of feed material, or chips, which is continually displaced in an axial direction and deposited at an even rate around the circumference in the intake zone between the grinding disks, thereby ensuring that the feed material will pass into and through the grinding zone without disturbing fluctuations, which in turn has a beneficial effect on the result of the grinding process.

BRIEF DESCRIPTION OF THE DRAWING

The invention will be described in closer detail below with reference to the embodiment illustrated by way of an example in the accompanying drawings, and in the course of the description other characteristic features of the invention will be indicated.

DETAILED DESCRIPTION OF AN EMBODIMENT OF THE INVENTION

Figure 1:
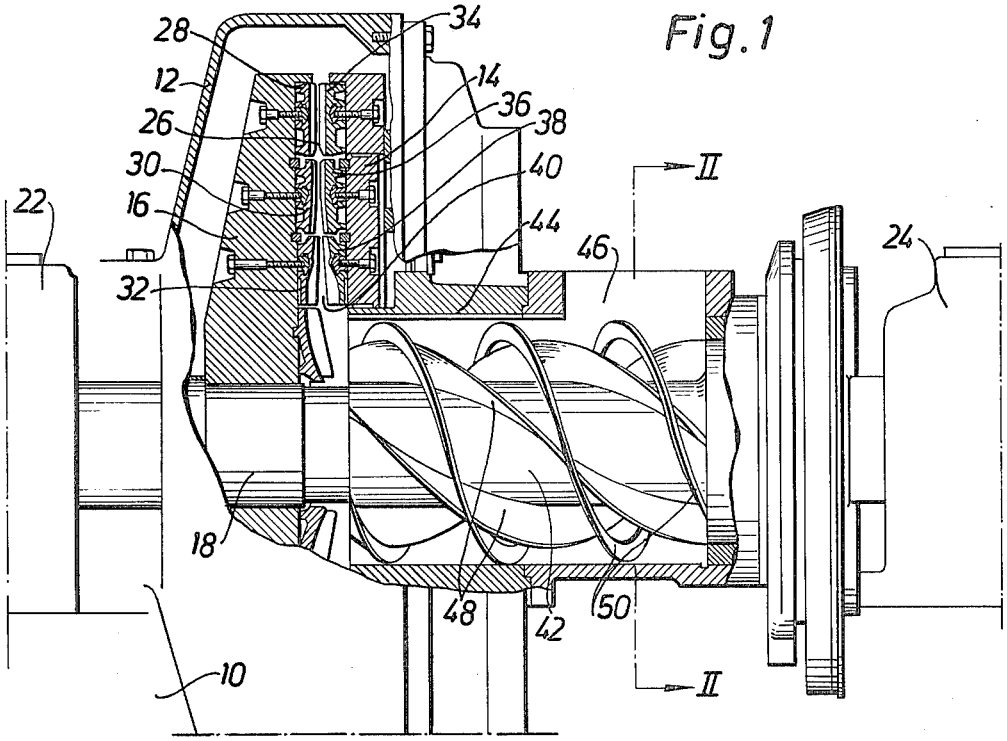
FIG. 1 shows a side view of a grinding apparatus, partly in longitudinal section.
Figure 2:
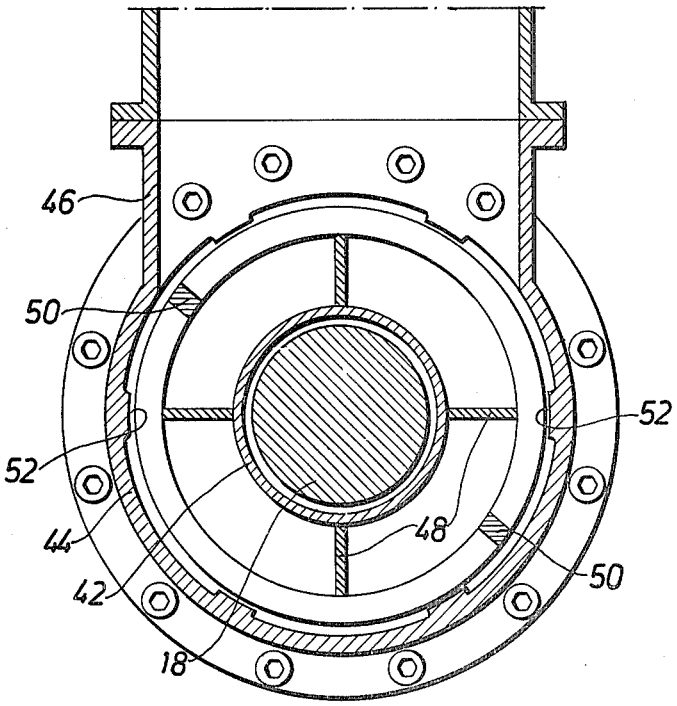
FIG. 2 shows a cross-section on the line II—II in FIG. 1.

The FIG. 10 in the drawings denotes a frame on which is mounted a housing 12 enclosing two mutually rotatable grinding disks. In the embodiment illustrated one of these, denoted 14, is stationary in the housing 12 while the other grinding disk 16 is fixed to a shaft 18 journaled in sections 22, 24 G of the frame on either side of the housing 12. In addition to the shaft bearings, sections 22, 24 also house in a well-known manner drive means for the shaft and a fluid-actuated servo-motor which generates the grinding pressure in the space 26 between the two grinding disks, the rotating disk 16 being axially moveable. The grinding disks are fitted with rings of grinding plates 28, 30, 32; 34, 36, 38, which jointly form the grinding space and a feed-in zone 40 thereto.

The shaft 18 is closely and concentrically surrounded by the cylindrical sleeve 42 of a feed screw, between which and a wall 44 the feed material, such as chips, is conveyed axially from a feed intake opening 46 to the intake zone 40 between the grinding disks. According to the invention, there are mounted on the cylinder 42 preferably four wing-shaped vanes 48 and outside these a smaller number, as two ribbon screw threads 50. While the vanes 48 are fixed to the cylinder 42 the screw threads 50 are rigidly united, e.g. by welding, to the outside edges of the vanes. The inner vanes, like the outer threads 50, are of screw form but have a steeper pitch than the latter. These sets of screw threads are so positioned with respect to each other that the vanes 48 primarily propel the feed material, after its entry through the feed intake 46, radially outwards and in any case exert a very small axial component thereon, while the outer screw threads 50 convey the feed material axially. The result of the combined action of these two sets of elements is to spread the feed material round the inside of the wall 44 in the form of a pipe of thickness approximately equal to the radial extension of the screw thread 50 and to distribute and deposit this "pipe" of feed material uniformly and at an even rate around the circumference of the space between the disks in the intake zone 40 thereto.

While the conveyor screw rotates at e.g. 150 r.p.m. the speed of rotation of the shaft 18 is considerably greater, e.g. 1500–1800 r.p.m. A number of low, axially oriented strips 52 may be located at intervals around the inside circumference of the wall 44.

The invention is naturally not restricted to the embodiment shown but may be varied in a number of respects within the terms of the concept underlying it. Thus the vanes may be axially oriented, in which case their pitch is infinite. The vanes need each extend for only part of the full length of the conveyor screw. The essential feature is only that they shall jointly form and maintain the "pipe" of chips which is conveyed axially towards the grinding disks by the outer screw threads.

I claim:

1. In a grinding apparatus in which lignocellulosic material is ground in a grinding space defined between a pair of grinding discs which are mounted on a shaft to rotate relatively to one another within a housing into which the material is advanced through a feed-in sleeve having a wall surrounding the shaft, from an intake opening to a feed-in zone, by conveyor means carried by said shaft to rotate within said sleeve, the improvement comprising:

(a) solid inner screw conveyor means mounted on said shaft;

(b) outer ribbon screw means supported on the crest of the flights of said inner screw means for common rotation therewith;

(c) said inner screw means having a pitch steeper than that of said outer screw means; and (d) the flights of said inner means and said outer screw means being positioned relative to one another so that said inner screw means will propel the material mainly in a radially outward direction against the wall of said sleeve and fill the grooves of said ribbon-like screw means to be advanced axially by the latter in the form of a pipe into the feed-in zone during the common rotation of said screw means.

2. A grinding apparatus according to claim 1, in which the height of the crest of the inner solid screw means is greater than that of the outer ribbon-like screw means.

3. A grinding apparatus according to claims 1 or 2, in which the inner solid screw means comprises a greater number of screw flights than the outer ribbon-like screw means.

4. A grinding apparatus according to claim 1, in which said inner screw means are mounted on a cylinder concentrically enclosing said shaft.

* * * * *